US010321214B2

(12) United States Patent
Yoshino

(10) Patent No.: US 10,321,214 B2
(45) Date of Patent: Jun. 11, 2019

(54) MICROPHONE

(71) Applicant: Audio-Technica Corporation, Tokyo (JP)

(72) Inventor: Satoshi Yoshino, Tokyo (JP)

(73) Assignee: AUDIO-TECHNICA CORPORATION, Tokyo (JP)

( * ) Notice: Subject to any disclaimer, the term of this patent is extended or adjusted under 35 U.S.C. 154(b) by 0 days.

(21) Appl. No.: 15/691,847

(22) Filed: Aug. 31, 2017

(65) Prior Publication Data

US 2018/0152777 A1 May 31, 2018

(30) Foreign Application Priority Data

Nov. 29, 2016 (JP) ..... 2016-230892

(51) Int. Cl.

| | |
|---|---|
| ***H04R 1/04*** | (2006.01) |
| ***H04R 1/08*** | (2006.01) |
| ***H04R 3/00*** | (2006.01) |
| ***H04R 19/00*** | (2006.01) |
| ***H04R 31/00*** | (2006.01) |

(52) U.S. Cl.

CPC ..... *H04R 1/083* (2013.01); *H04R 1/04* (2013.01); *H04R 3/00* (2013.01); *H04R 19/00* (2013.01); *H04R 31/006* (2013.01)

(58) Field of Classification Search

CPC . H04R 1/04; H04R 1/08; H04R 19/04; H04R 1/083; H04R 1/086; H04R 9/08; H04R 1/342; H04R 1/06; H04R 31/006; H04R 1/02; H04R 3/00; H04R 9/048; H04R 2420/07; H04R 31/00; H04R 1/028; H04R 1/28

USPC ..... 381/363

See application file for complete search history.

(56) References Cited

U.S. PATENT DOCUMENTS 5,988,585 A * 11/1999 Eaton ..... H04R 1/08 248/559

2011/0206221 A1* 8/2011 Yoshino ..... H04R 1/086 381/174

FOREIGN PATENT DOCUMENTS

| | | | |
|---|---|---|---|
| JP | 2008-11165 A | | 1/2008 |
| JP | 2008011165 A | * | 1/2008 |
| JP | 2009147860 A | * | 7/2009 |

* cited by examiner

*Primary Examiner* — Curtis A Kuntz
*Assistant Examiner* — Julie X Dang
(74) *Attorney, Agent, or Firm* — W&C IP

(57) ABSTRACT

A microphone is provided that restrains backlash relative to the microphone stand with a simple structure. A microphone is inserted in a connector-supporting hole of a microphone stand, and includes a microphone unit, an output connector configured to output sound signals from the microphone unit, a case accommodating the output connector, and an elastic member configured to be disposed in the connector-supporting hole while a portion of the case is inserted in the connector-supporting hole.

11 Claims, 6 Drawing Sheets

MICROPHONE

TECHNICAL FIELD

The present invention relates to a microphone.

BACKGROUND ART

Microphones for conferences are mounted to microphone stands placed on desks, and are used by conference attendees (see, for example, Japanese Patent Application Publication No. 2008-11165). Such microphones are mountable to and dismountable from microphone stands. A microphone for a conference includes a microphone unit, an output connector, and a microphone housing (connector case). The microphone unit is a condenser microphone unit configured to output sound signals in response to sound waves from a sound source, for example.

The output connector is connected with an input connector (receptacle) of the microphone stand, which will be described below, and outputs sound signals from the microphone unit to the microphone stand. The output connector includes pin plugs which conform to the JEITA Standard RC-5236 "Circular connectors, latch lock type for audio equipment," for example. The output connector includes a cylindrical base, a first pin for grounding, a second pin for sound signals at the hot side, and a third pin for sound signals at the cold side.

The connector case accommodates the output connector and serves as the ground line for sound signals. The connector case is composed of metal and has a shape of a cylinder. The connector case includes a latch groove to which a latch claw, which will be described below, fits. The latch groove is disposed on the inner circumferential surface at the base end portion of the connector case. The "base end portion" is an end portion of the connector case and is to be inserted in a connector-supporting hole, as described below. The output connector is accommodated in the connector case and is fixed with screws.

The microphone stand supports the microphone and outputs sound signals from the microphone to external devices such as mixers. The microphone stand includes the input connector to be connected to the output connector of the microphone.

The input connector is a socket receptacle which conforms to the JEITA Standard RC-5236 "Circular connectors, latch lock type for audio equipment", for example. The input connector includes a housing, a pin-receiving portion, a connector-supporting hole, and a latch-locking mechanism.

The housing supports the pin-receiving portion and the latch-locking mechanism. The housing is composed of metal and has a shape of a cylinder, for example. The pin-receiving portion holds three pins which connect to the first to third pins of the output connector. The pin-receiving portion is composed of synthetic resin and has a shape of a cylinder. The pin-receiving portion is fixed to the inside of the housing. The connector-supporting hole supports the base end portion of the connector case. The connector-supporting hole is a cylindrical space defined by the inner circumferential surface of the housing and the outer circumferential surface of the pin-receiving portion.

The latch-locking mechanism fixes the base end portion of the connector case into the connector-supporting hole. The latch-locking mechanism includes a latch claw and a release lever. The latch claw fixes the connector case to the input connector. The latch claw is disposed on the outer circumferential surface of the pin-receiving portion in the connector-supporting hole. The latch claw can advance and retract in the radial direction of the pin-receiving portion. The latch claw is electrically connected with a ground line of the input connector. The release lever moves the latch claw inwardly to the radial direction of the pin-receiving portion.

The base end portion of the connector case is inserted in the connector-supporting hole in the input connector when the microphone is mounted to the microphone stand. The latch claw of the input connector is fit into the latch groove of the connector case. That is, the microphone is fixed to the input connector through one latch and the latch groove. The microphone is no longer movable in the longitudinal direction of the microphone after fitting of the latch claw into the latch groove. The latch claw is then electrically connected with the latch groove (connector case) and serves as the ground line for sound signals.

The latch claw retracts from the latch groove when an operator of the microphone presses down the release lever. As a result, the microphone is dismounted from the microphone stand. As described above, the microphone is mountable to and dismountable from the microphone stand.

SUMMARY OF INVENTION

Technical Problem

In order to facilitate mounting to and dismounting from the microphone stand of the microphone, the diameter of the connector-supporting hole is larger than the outer diameter of the base end portion of the connector case. When the microphone is mounted to the microphone stand, a gap is formed between the outer circumferential surface at the base end portion of the connector case and the inner circumferential surface of the housing. Such a gap generates backlash of the microphone relative to the microphone stand. That is, when a desk is shaken on which the microphone stand is placed, for example, the microphone pendulums on the latch claw as a pivot within the gap. As a result, the position of the tip of the microphone is not securely fixed, for the goose neck type microphones having a long length, for example.

When the backlash of the microphone is generated, the vibration of a desk, for example, is transmitted to the microphone, and the microphone unit generates noise signals (noise) due to the vibration and outputs them. When the backlash of the microphone is generated, the electric connection of the latch claw with the latch groove is no longer stable, and the ground line of the microphone becomes unstable. Thus, the electromagnetic waves from the exterior of the microphone intrude into the connector case (base end portion) through the gap between the connector case and the connector. As a result, the microphone unit generates noise due to electromagnetic waves and outputs them. Furthermore, when the ground line for the microphone becomes unstable, the voltage of the phantom power supplied to the microphone unit fluctuates positively and negatively. As a result, failure, damage, and malfunction of semiconductors and LEDs included in the microphone may occur.

An object of the present invention is to solve the problem described above and to provide a microphone having restrained backlash relative to the microphone stand with a simple structure.

Solution to Problem

The microphone according to the present invention is a microphone to be inserted in a connector-supporting hole of a microphone stand, and includes a microphone unit, an output connector configured to output sound signals from the microphone unit to the exterior, a case accommodating the output connector, and an elastic member configured to be disposed in the connector-supporting hole while a portion of the case is inserted in the connector-supporting hole.

Advantageous Effects of Invention

The microphone according to the present invention can restrain backlash relative to microphone stand with a simple structure.

DESCRIPTION OF EMBODIMENTS

Microphone (1)

Embodiments of the microphone according to the present invention (hereinafter referred to as "the first embodiment") will now be described with reference to the attached drawings.

Structure of Microphone (1)

Figure 1:
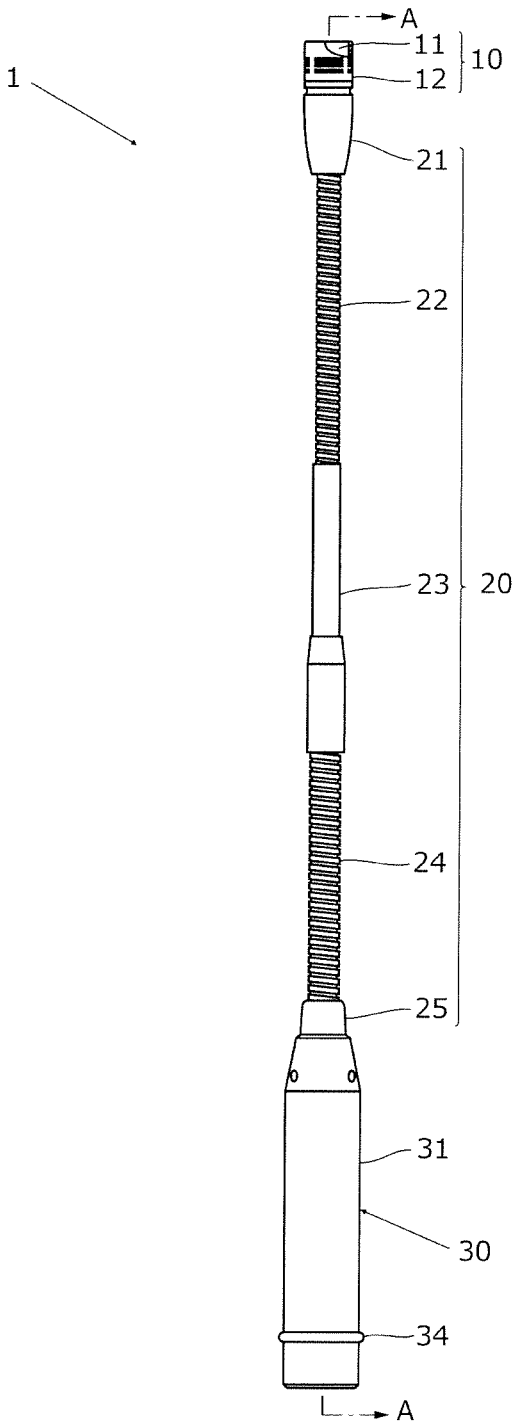
FIG. 1 is an external view of an embodiment of a microphone according to the present invention.

FIG. 1 is an external view of an embodiment of a microphone according to the present invention.

A microphone 1 collects sound waves from a sound source and outputs electric signals corresponding to the sound waves. The microphone 1 is a goose neck type microphone mounted to a microphone stand 4, which will be described below. The microphone 1 is mountable to and dismountable from the microphone stand 4. The microphone 1 includes a sound collecting portion 10, a coupling portion 20, a connecting portion 30, and a microphone cable (not shown).

In the description below, the direction to the upper side of FIG. 1 is referred to as the upper direction, and the direction to the lower side of FIG. 1 is referred to as the lower direction.

The sound collecting portion 10 is directed to a sound source, and collects sound waves from the sound source. The sound collecting portion 10 includes a microphone unit 11 and a microphone case 12. The microphone unit 11 is configured to output electric signals corresponding to the sound waves received from the sound source. The microphone unit 11 is a condenser microphone unit, for example. The microphone case 12 accommodates the microphone unit 11.

The coupling portion 20 couples the sound collecting portion 10 with the connecting portion 30. The coupling portion 20 includes a first case 21, a first flexible pipe 22, a joint 23, a second flexible pipe 24, and a second case 25.

The first case 21 couples the sound collecting portion 10 with the first flexible pipe 22. The first flexible pipe 22 and the second flexible pipe 24 are bent to adjust the position of the sound collecting portion 10. The joint 23 couples the first flexible pipe 22 with the second flexible pipe 24. The second case 25 couples the second flexible pipe 24 with the connecting portion 30.

The sound collecting portion 10 is coupled to one end of the first flexible pipe 22 through the first case 21. The other end of the first flexible pipe 22 is coupled to one end of the second flexible pipe 24 through the joint 23. The other end of the second flexible pipe 24 is coupled to the connecting portion 30 through the second case 25.

Figure 2:
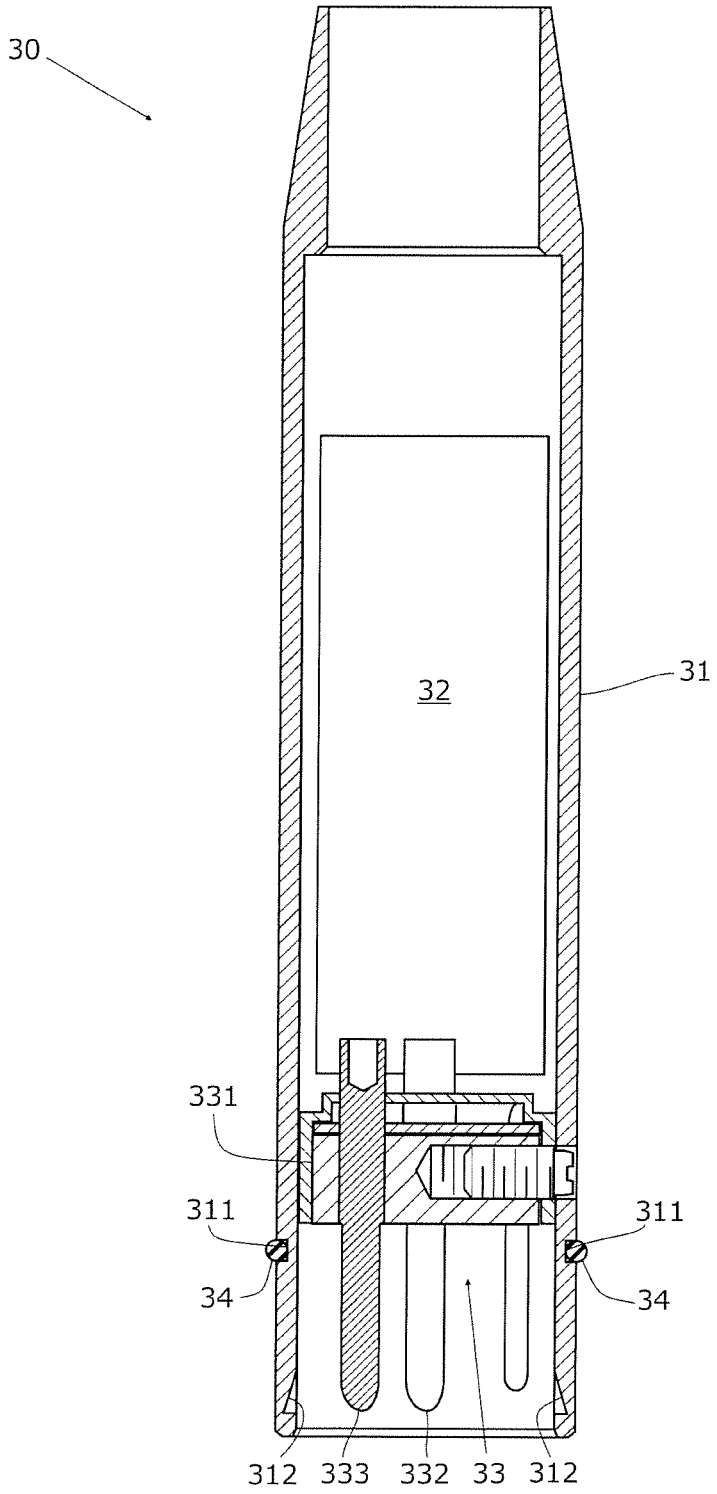
FIG. 2 is a cross-sectional view of a connecting portion of the microphone of FIG. 1 taken along the line A-A.

FIG. 2 is a cross-sectional view taken along the line A-A of the connecting portion 30 in FIG. 1.

The connecting portion 30 connects the microphone unit 11 to an input connector of the microphone stand 4, which will be described below. The connecting portion 30 includes a connector case 31, a circuit board 32, an output connector 33, and an elastic member 34.

The connector case 31 accommodates the circuit board 32 and the output connector 33. The connector case 31 is composed of metal and has a substantially cylindrical shape. The connector case 31 is an exemplary case in the present invention. The connector case 31 includes a groove 311 and a latch groove 312. The groove 311 fixes the position of the elastic member 34 on the connector case 31. The groove 311 is disposed on the outer circumferential surface at the lower end of the connector case 31, in a shape of a ring in the circumferential direction of the connector case 31. The latch groove 312 is disposed on the inner circumferential surface at the lower end of the connector case 31. The function of the latch groove 312 will be described below.

The circuit board 32 is composed of synthetic resin, and has a shape of a rectangular plate, for example. The circuit board 32 includes a circuit, such as a balanced transmission circuit (not shown) outputting sound signals from the microphone unit 11 to the output connector 33. The circuit board 32 is accommodated in the connector case 31.

The output connector 33 outputs sound signals from the circuit board 32. The output connector 33 is a pin plug which conforms to the JEITA Standard RC-5236 "Circular connectors, latch lock type for audio equipment," for example. The output connector 33 includes a cylindrical base 331, a first pin for grounding (not shown), a second pin 332 at the hot side of sound signals, and a third pin 333 at the cold side of sound signals. The output connector 33 is accommodated at the lower end of the connector case 31, and is fixed by a screw.

The elastic member 34 is composed of synthetic resin such as nitrile rubber or silicone rubber having elasticity. The elastic member 34 is a circular O-ring in the cross-sectional view. The inner diameter of the elastic member 34 is smaller than the outer diameter of the groove 311 of the connector case 31. The elastic member 34 is fit (disposed) into groove 311 of the connector case 31. That is, the elastic member 34 is disposed on the outer circumferential surface of the connector case 31. The outer diameter of the elastic member 34 is larger than that of the connector case 31. Thus, a portion of the elastic member 34 protrudes from the outer circumferential surface of the connector case 31. The diameter of an imaginary circle C1 (the outer diameter of the elastic member 34 in the present embodiment) circumscribing the elastic member 34 is larger than the inner diameter of a housing 51 (see FIG. 4) of an input connector 50 for the microphone stand 4, which will be described below.

The elastic member in the present invention is not limited to an O-ring. That is, the elastic member may be a cylindrical tube, for example.

The microphone cable transmits the sound signals from the microphone unit 11 to the circuit board 32. The microphone cable is disposed in the coupling portion 20 and is connected with the microphone unit 11 and the circuit board 32.

Microphone Stand

The microphone stand 4 will now be described to which the microphone according to the present invention is mounted.

Structure of Microphone Stand

Figure 3:
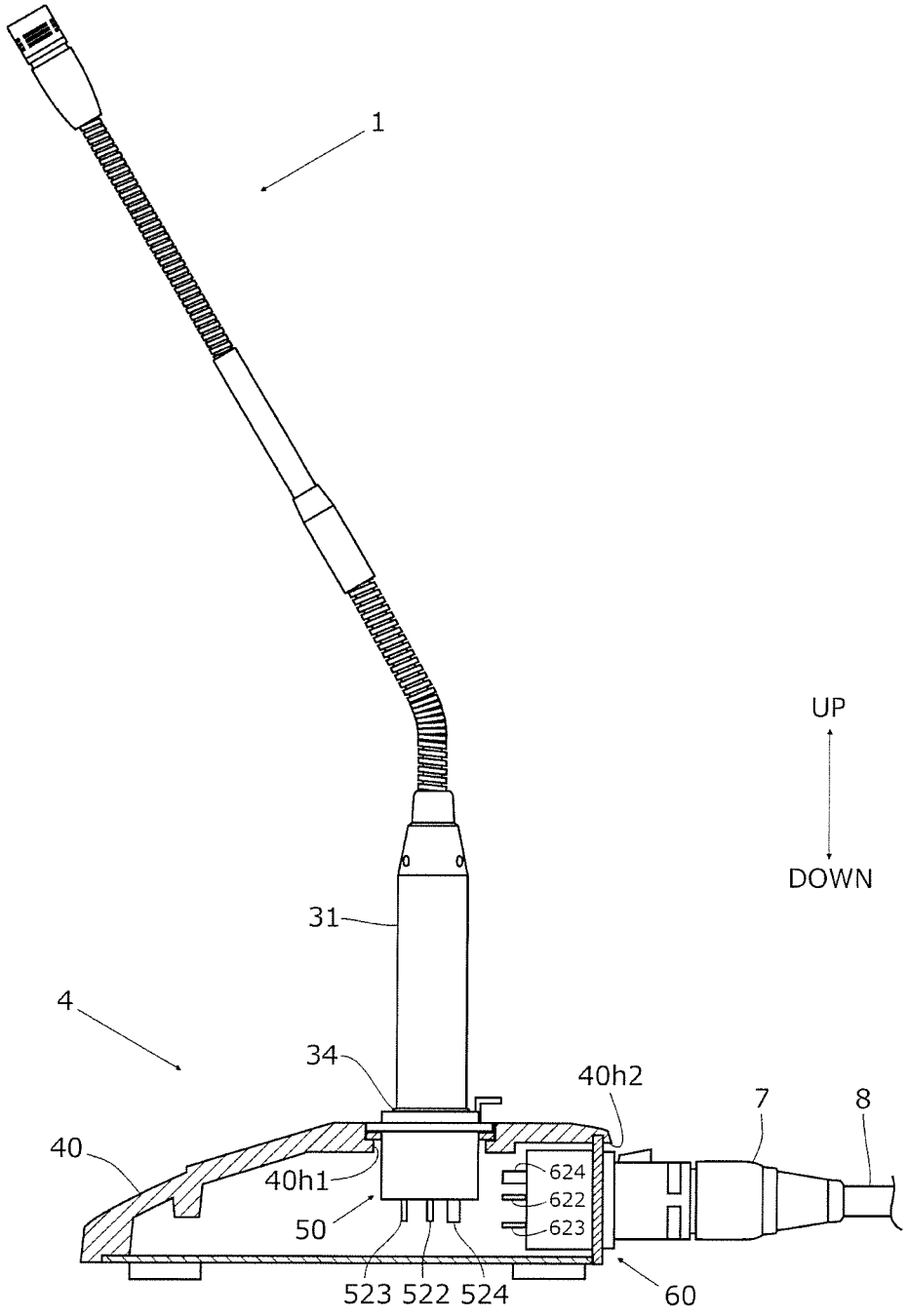
FIG. 3 is a schematic view illustrating an exemplary use of the microphone in FIG. 1.

FIG. 3 is a schematic view illustrating an exemplary use of the microphone 1.

FIG. 3 illustrates the microphone stand 4 with the microphone 1 mounted thereto.

The microphone stand 4 holds the microphone 1 standing on it. The microphone stand 4 includes a base housing 40, an input connector 50, and an external output connector 60.

The base housing 40 supports the microphone 1 through the input connector 50. The base housing 40 is composed of metal, and is flat and hollow. The base housing 40 includes a first connector mounting hole **40*h*1 and a second connector mounting hole 40*h*2. The first connector mounting hole 40*h*1 is disposed on the upper face (the upper face in FIG. 3) of the base housing 40. The second connector mounting hole 40*h*2 is disposed on the rear face (the right side face in FIG. 3) of the base housing 40**.

Figure 4:
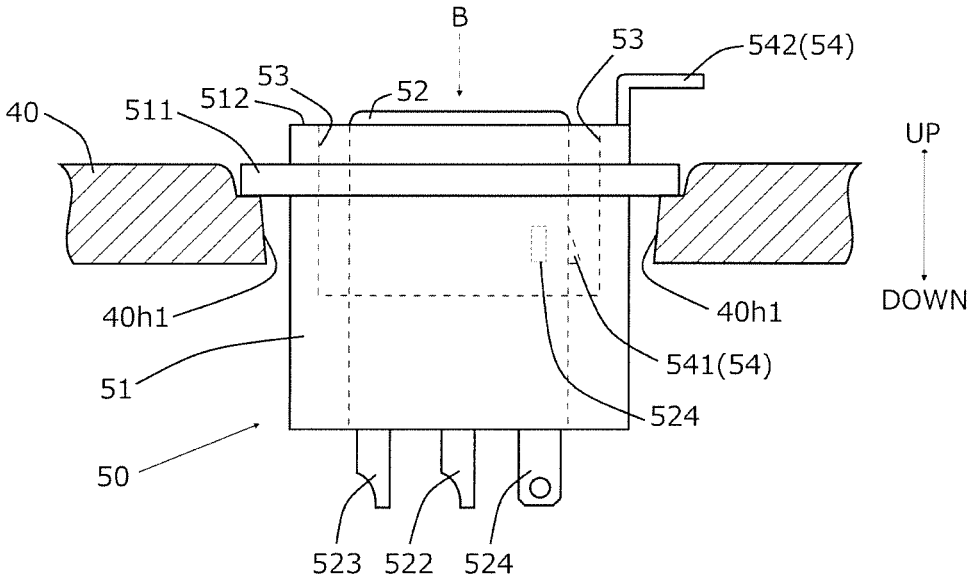
FIG. 4 is a partial cross-sectional view of an input connector of a microphone stand of FIG. 3.

FIG. 4 is a partial cross-sectional view of the input connector 50.

Figure 5:
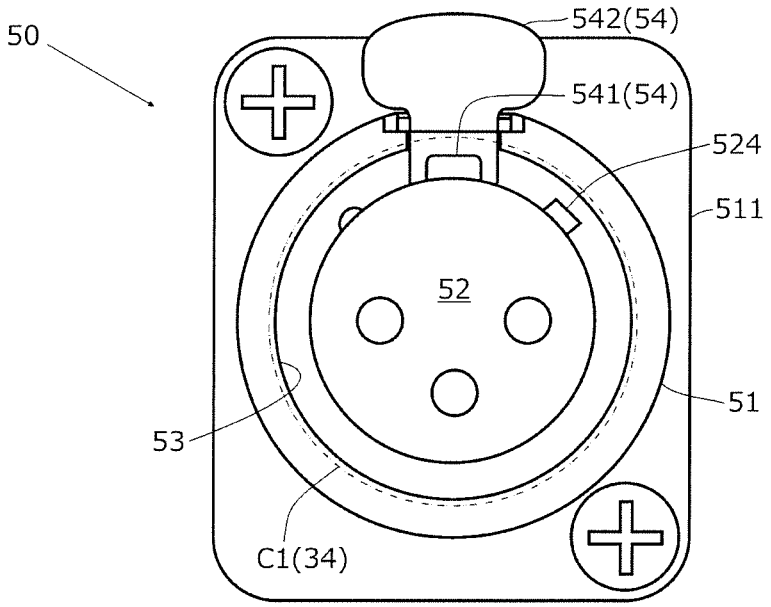
FIG. 5 is a view of the input connector in FIG. 4 viewed along arrow B.

FIG. 5 is a view of the input connector 50 viewed along from the perspective of an arrow B in FIG. 4.

For convenience of explanation, the two dot chain lines in FIG. 5 illustrate the outer diameter of the elastic member 34 after the microphone 1 has been mounted to the microphone stand 4.

The input connector 50 couples with the output connector 33 of the microphone 1 to output the sound signals from the microphone 1 to the external output connector 60 (see FIG. 3). The input connector 50 is a socket receptacle which conforms to the JEITA Standard RC-5236 "Circular connectors, latch lock type for audio equipment," for example. The input connector 50 is mounted into the first connector mounting hole **40*h*1 of the base housing 40. The input connector 50 includes the housing 51, a pin-receiving portion 52, a connector-supporting hole 53, and a latch-locking mechanism 54**.

The housing 51 accommodates the pin-receiving portion 52. The housing 51 is composed of metal and has a shape of a cylinder, for example. The housing 51 is an exemplary input connector housing in the present invention. The inner diameter of the upper portion of the housing 51 is larger than that of the lower portion of the housing 51. The housing 51 includes a flange portion 511 having a rectangular shape in the top view. The flange portion 511 fixes the housing 51 to the base housing 40. The flange portion 511 is disposed on the outer circumferential surface of the upper portion of the housing 51.

The pin-receiving portion 52 connects with the output connector 33 of the microphone 1. The pin-receiving portion 52 is composed of synthetic resin and has a shape of a cylinder. The pin-receiving portion 52 is disposed within the housing 51. The outer circumferential surface of the upper portion of the pin-receiving portion 52 faces the inner circumferential surface of the upper portion of the housing 51. The lower portion of the pin-receiving portion 52 is fit into the lower portion of the housing 51. The pin-receiving portion 52 includes a first pin (not shown), a second pin 522, a third pin 523, and a ground terminal 524. The first pin, the second pin 522, and the third pin 523 protrude downwardly from the pin-receiving portion 52. As shown in FIG. 5, one end of the ground terminal 524 is disposed on the outer circumferential surface of the upper portion of the pin-receiving portion 52. This end of the ground terminal 524 can advance and retract in the radial direction of the pin-receiving portion 52. That is, this end of the ground terminal 524 protrudes into the connector-supporting hole 53, which will be described below. As shown in FIG. 4, the other end of the ground terminal 524 protrudes downwardly from the pin-receiving portion 52.

The connector-supporting hole 53 supports the bottom portion of the connector case 31. The connector-supporting hole 53 is a cylindrical space defined by the inner circumferential surface of the upper portion of the housing 51 and the outer circumferential surface of the upper portion of the pin-receiving portion 52. That is, the connector-supporting hole 53 is disposed between the housing 51 and the pin-receiving portion 52. The inner diameter of the upper portion of the housing 51 is larger than the outer diameter of the connector case 31 of the microphone 1 (see FIG. 2), and is smaller than the outer diameter of the elastic member 34 of the microphone 1. In other words, the outer diameter (an imaginary circle C1 circumscribing the elastic member 34) of the elastic member 34 is larger than the inner diameter (the outer diameter of the connector-supporting hole 53) of the housing 51.

The latch-locking mechanism 54 fixes the connector case 31 into the connector-supporting hole 53. The latch-locking mechanism 54 includes a latch claw 541 and a release lever 542. The latch claw 541 fixes the connector case 31 into the connector-supporting hole 53. The latch claw 541 is disposed on the outer circumferential surface of the upper portion of the pin-receiving portion 52. The latch claw 541 can advance and retract in the radial direction of the pin-receiving portion 52. The latch claw 541 is electrically connected to the ground terminal 524. The release lever 542 moves the latch claw 541 into the pin-receiving portion 52. The release lever 542 protrudes from the upper face 512 on the housing 51.

Referring now back to FIG. 3, the external output connector 60 outputs the sound signals from the input connector 50 to external devices such as mixers (not shown). The external output connector 60 has the same configuration as the input connector 50. That is, the external output connector 60 includes a first pin (not shown), a second pin 622, a third pin 623, and a ground terminal 624. The external output connector 60 is mounted into the second connector mounting hole **40*h*2 in the base housing 40. A plug 7 is inserted in the external output connector 60. The plug 7 is connected to external devices through a cable 8**.

The first pin of the external output connector 60 is electrically connected with the first pin of the input connector 50. The second pin 622 of the external output connector 60 is electrically connected with the second pin 522 of the input connector 50. The third pin 623 of the external output connector 60 is electrically connected with the third pin 523 of the input connector 50. The ground terminal 624 of the external output connector 60 is electrically connected with the ground terminal 524 of the input connector 50, and is connected with the ground of the external devices. That is, the ground terminal 524 and the latch claw 541 of the input connector 50 are grounded through the ground terminal 624 of the external output connector 60.

Mounting to and Dismounting from Microphone Stand of Microphone (1)

Referring to FIGS. 2 and 4, mounting to and dismounting from the microphone stand 4 of the microphone 1 will now be described.

The microphone 1 is mounted to the microphone stand 4 by inserting the lower end of the connector case 31 into the connector-supporting hole 53 of the input connector 50. That is, the microphone 1 is mounted to the microphone stand 4 by inserting the microphone 1 into the connector-supporting hole 53.

When the lower end of the connector case 31 is inserted in the connector-supporting hole 53 of the input connector 50, the first pin, the second pin 332, and the third pin 333 of the output connector 33 of the microphone 1 are inserted in the pin-receiving portion 52. Then, the ground terminal 524 and the latch claw 541 are pressed onto the inner circumferential surface of the connector case 31, and retract into the pin-receiving portion 52. Then, the elastic member 34 comes into contact with the inner edge portion at the upper end of the housing 51.

The elastic member 34 has an upper side portion and a lower side portion. After contact with the housing 51, the lower side portion of the elastic member 34 is pressed to the connector case 31 by the housing 51 and deforms to be forced (inserted) in the connector-supporting hole 53. The lower side portion of the elastic member 34 bites into the gap (connector-supporting hole 53) between the outer circumferential surface of the connector case 31 and the inner circumferential surface of the housing 51. As described above, the elastic member 34 has a shape of a circular O-ring in a cross-sectional view. That is, the outer diameter of the elastic member 34 becomes smaller in the direction from the middle portion to lower portion of the elastic member 34. Thus, the lower portion of the elastic member 34 can be readily inserted in the connector-supporting hole 53.

Then, the latch claw 541 of the input connector 50 is fit into the latch groove 312 of the connector case 31. As a result, the microphone 1 is mechanically coupled to the microphone stand 4 and mounted erect. The first pin of the output connector 33 in the microphone 1 is electrically connected to the first pin of the input connector 50. The second pin 332 of the output connector 33 in the microphone 1 is electrically connected with the second pin 522 of the input connector 50. The third pin 333 of the output connector 33 in the microphone 1 is electrically connected with the third pin 523 of the input connector 50.

Figure 6:
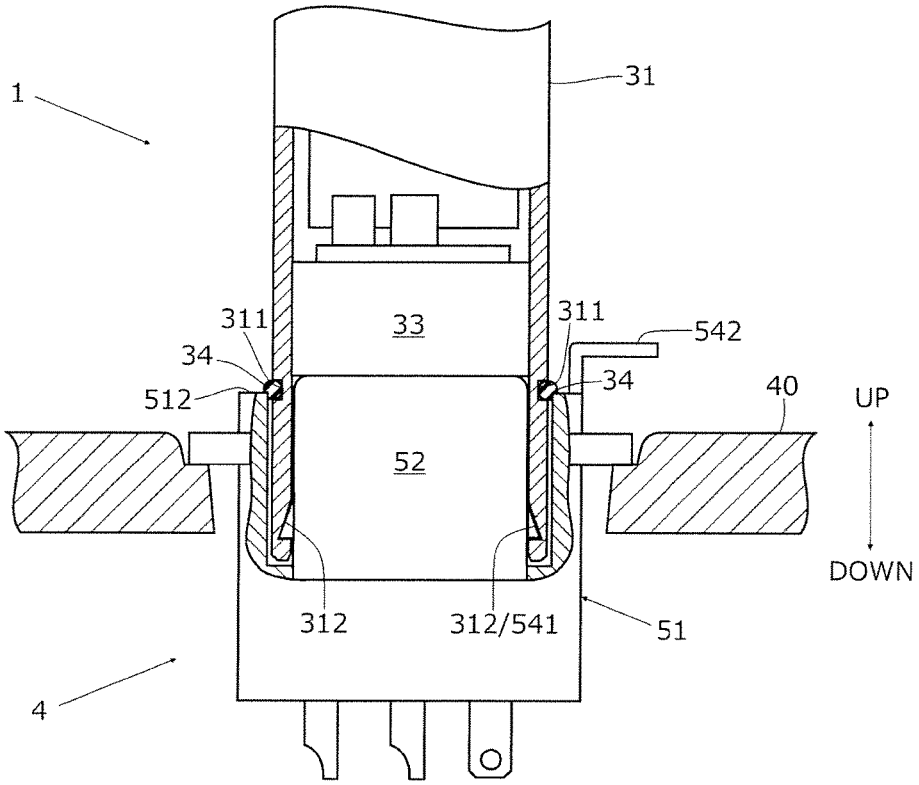
FIG. 6 is a cross-sectional view of the connector portion of the microphone mounted to the microphone stand.

FIG. 6 is a cross-sectional view of a portion of the output connector 33 of the microphone 1 mounted to the microphone stand 4. FIG. 6 illustrates the cross-section of a portion of the connector case 31 and a portion of the housing 51.

While the lower end portion of the connector case 31 is inserted in the connector-supporting hole 53, the latch claw 541 is fit in the latch groove 312 to regulate the movement of the connector case 31 in the longitudinal direction (the vertical direction in FIG. 6). The latch claw 541 comes into contact with the latch groove 312. The ground terminal 524 (see FIG. 5) is kept retracted in the pin-receiving portion 52 by the inner circumferential surface of the connector case 31. That is, the connector case 31 is electrically connected with the ground terminal 524 and the latch claw 541. As a result, the connector case 31 is connected with the ground of external devices through the ground terminal 524 and the latch claw 541. In other words, the ground terminal 524 and the latch claw 541 form a ground line for the microphone 1 through the electrical connection with the connector case 31.

While the lower end portion of the connector case 31 is inserted in the connector-supporting hole 53, the elastic member 34 fitted in the groove 311 of the connector case 31 is disposed near the upper face 512 of the housing 51. That is, while the bottom portion of the connector case 31 is inserted in the connector-supporting hole 53, the lower side portion of the elastic member 34 is compressed by the housing 51 against the connector case 31 in the entire circumference and is deposed in the connector-supporting hole 53. While the lower end portion of the connector case 31 is inserted in the connector-supporting hole 53, the upper side portion of the elastic member 34 is exposed from the connector-supporting hole 53.

Figure 7:
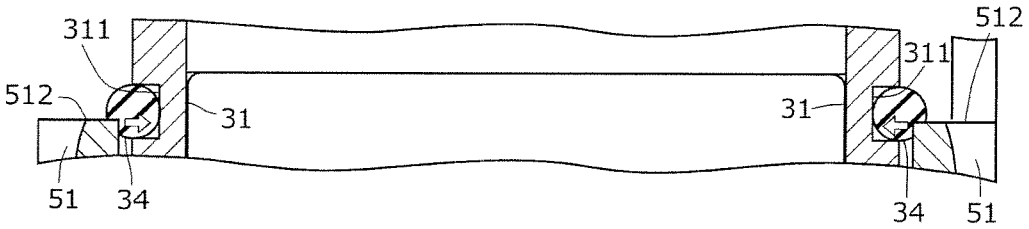
FIG. 7 is an enlarged cross-sectional view of the elastic member in FIG. 6.

FIG. 7 is an enlarged cross-sectional view of the elastic member 34 in FIG. 6.

FIG. 7 schematically illustrates compressive force received by the elastic member 34 from the housing 51 with an outlined arrow.

The connector case 31 is pressed by the lower side portion of the elastic member 34 toward the center of the connector case 31 in the radial direction in the entire circumference as the lower side portion of the elastic member 34 is compressed by the housing 51. As a result, the elastic member 34 regulates the movement of the connector case 31 in the radial direction (the horizontal direction in FIG. 7).

As described above and shown in FIG. 6, the connector case 31 is fixed by the elastic member 34 at the upper end of the connector-supporting hole 53. The connector case 31 is not movable in the radial direction of the connector case 31. The connector case 31 is fixed by the latch claw 541 and the latch groove 312 at the lower end of the connector-supporting hole 53. The connector case 31 is not movable in the longitudinal direction (the vertical direction) of the connector case 31. Even when a desk with the microphone stand 4 placed thereon is shaken, the microphone 1 does not pendulum on the latch claw 541 as a pivot. That is, the microphone according to the present invention can restrain the backlash relative to a microphone stand more effectively than the traditional microphones fixed to an input connector only with a latch claw fitted in a latch groove. As a result, stable electrical connection is established between the connector case 31 and the latch claw 541 and between the connector case 31 and the ground terminal 524. A stable ground line for the microphone 1 is thereby established.

Returning to FIG. 6, when an operator of the microphone 1, for example, presses down the release lever 542, the latch claw 541 is dismounted from the latch groove 312. As a result, the microphone 1 is dismounted from the microphone stand 4. As described above, the upper side portion of the elastic member 34 is exposed from the connector-supporting hole 53. When the microphone 1 is dismounted from the microphone stand 4, the lower side portion of the elastic member 34 thus can be drawn from the connector-supporting hole 53 (the gap between the outer circumferential surface of the connector case 31 and the inner circumferential surface of the housing 51). That is, the microphone 1 can be readily dismounted from the microphone stand 4.

SUMMARY

In the microphone according to the embodiment described above, while a portion (the lower end) of the connector case 31 is inserted in the connector-supporting hole 53, a portion (the lower side portion) of the elastic member 34 is disposed in the connector-supporting hole 53. That is, the lower side portion of the elastic member 34 bites into the gap between the outer circumferential surface of the connector case 31 and the inner circumferential surface of the housing 51 of the input connector 50. Thus, the connector case 31 is fixed by the elastic member 34. The connector case 31 is not movable in the radial direction of the connector case 31. In other words, the microphone according to the present invention restrains the backlash relative to a microphone stand more effectively than the conventional microphones fixed to an input connector only with a latch claw fit in a latch groove. As a result, the ground line for the microphone 1 becomes stable.

In addition, in the microphone according to the embodiment described above, while the lower end portion of the connector case 31 is inserted in the connector-supporting hole 53, a portion (the upper side portion) of the elastic member 34 is exposed from the connector-supporting hole 53. When the microphone 1 is dismounted from the microphone stand 4, the lower side portion of the elastic member 34 thus can be readily dismounted from the connector-supporting hole 53. When the microphone 1 is mounted to the microphone stand 4, only a portion of the elastic member 34 is fit into the connector-supporting hole 53. Thus, the microphone 1 can be readily mounted to the microphone stand 4. That is, the microphone according to the present invention restrains the backlash relative to the microphone stand and facilitates mounting to and dismounting from the microphone stand of the microphone.

Furthermore, in the microphone according to the embodiment described above, the diameter of an imaginary circle C1 circumscribing the elastic member 34 (the diameter of the elastic member 34) is larger than the inner diameter of the housing 51 of an input connector 50. While the lower portion of the connector case 31 is inserted in the connector-supporting hole 53, the lower side portion of the elastic member 34 is compressed by the housing 51 against the connector case 31. That is, the connector case 31 is pressed by the lower side portion of the elastic member 34 toward the center of the connector case 31 in the radial direction in the entire circumference. As a result, the elastic member 34 regulates the movement of the connector case 31 in the radial direction. In other words, the microphone according to the present invention restrains the backlash relative to the microphone stand more effectively than the conventional microphones.

Furthermore, in the microphone according to the embodiment described above, the elastic member 34 is an O-ring disposed in the groove 311 disposed on the outer circumferential surface of the connector case 31. Thus, the microphone according to the present invention restrains the backlash relative to the microphone stand with a simple structure.

Furthermore, in the microphone according to the embodiment described above, while the lower end portion of the connector case 31 is inserted in the connector-supporting hole 53, the elastic member 34 fitted in the groove 311 of the connector case 31 is disposed near the upper face 512 of the housing 51 of the input connector 50. That is, while the lower end portion of the connector case 31 is inserted in the connector-supporting hole 53, a portion (the lower side portion) of the elastic member 34 disposed in the groove 311 is thereby disposed in the connector-supporting hole 53, and a portion (the upper side portion) of the elastic member 34 is exposed from the connector-supporting hole 53. As a result, the microphone according to the present invention restrains the backlash relative to the microphone stand, and facilitates mounting to and dismounting from the microphone stand of the microphone.

Furthermore, in the microphone according to the embodiment described above, while the lower end portion of the connector case 31 is inserted in the connector-supporting hole 53, the elastic member 34 fitted in the groove 311 of the connector case 31 is disposed near the upper face 512 of the housing 51 of the input connector 50. The output connector of the microphone and the input connector of the microphone stand are typically standard products such as those which conform to the JEITA Standard RC-5236. The microphone according to the present invention thereby restrains the backlash relative to the microphone stand, regardless of the form of the connector cases, such as a long connector case accommodating a circuit board or a transformer, and a connector case including a switch disposed on the outer circumferential surface.

Microphone (2)

Another embodiment of the microphone (hereinafter referred to as "the second embodiment") will now be described, focusing on the differences from the first embodiment described above. The microphone in the second embodiment differs from the first embodiment in the position and shape of the elastic member.

Configuration of Microphone (2)

Figure 8:
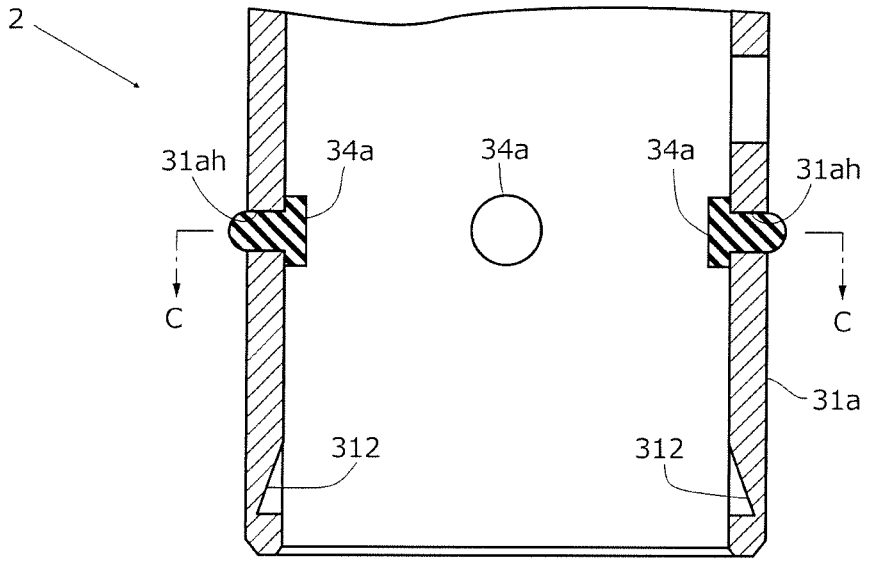
FIG. 8 is a cross-sectional view illustrating another embodiment of the microphone according to the present invention.

FIG. 8 is a cross-sectional view illustrating another embodiment of the microphone according to the present invention.

Figure 9:
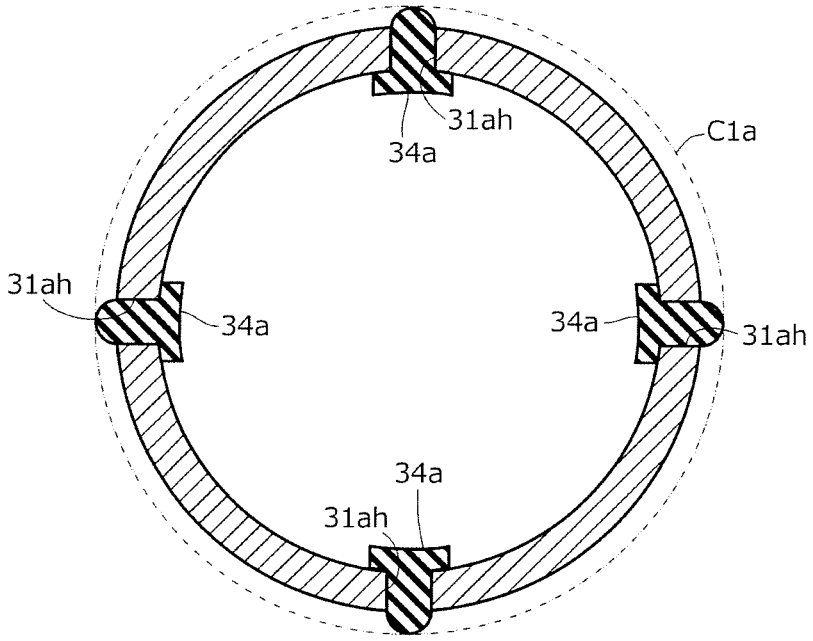
FIG. 9 is a cross-sectional view taken along the line C-C of the microphone in FIG. 8.

FIG. 9 is a cross-sectional view taken along the line C-C of the microphone in FIG. 8.

A microphone 2 includes a connector case 31*a* and at least one elastic member 34*a*. The connector case 31*a* of the microphone 2 includes four through holes 31*ah*, instead of the groove 311 of the connector case 31 of microphone 1 in the first embodiment. The through holes 31*ah* fix the elastic members 34*a*. The through holes 31*ah* are disposed at the lower end of the connector case 31*a* and at an equal interval in the circumferential direction of the connector case 31*a*.

The through holes in the present invention may be disposed at an equal interval in the circumferential direction of the connector case, and the number of the through holes is not limited to "four." That is, the number of the through holes may be "three" or "six," for example.

The elastic member 34*a* is composed of elastic synthetic resin, for example, nitrile rubber or silicone rubber. The elastic member 34*a* has a T shape in a cross-sectional view. The tip of the elastic member 34*a* has a shape of a hemisphere. The elastic member 34*a* is fit (disposed) into each of the through holes 31*ah* in the connector case 31*a*. A portion (tip) of the elastic member 34*a* protrudes from the outer circumferential surface of the connector case 31*a*. The diameter of an imaginary circle in contact with the tip of each of the elastic members 34*a*, or the imaginary circle C1*a* circumscribing each of the elastic members 34*a* is larger than the inner diameter of the housing 51 of the microphone stand 4 (the outer diameter of the connector-supporting hole 53).

The shape of the elastic member in the present invention is not limited to the present embodiment. That is, the elastic member may have a shape of a cylinder, for example.

Mounting to and Dismounting from Microphone Stand of Microphone (2)

Referring to FIGS. 4 and 8, mounting to and dismounting of the microphone 2 from the microphone stand 4 will now be described, focusing on the differences from the first embodiment.

The microphone 2 is mounted to the microphone stand 4 through insertion of the lower end portion of the connector case 31*a* into the connector-supporting hole 53 of the input connector 50.

While the lower end portion of the connector case 31*a* is inserted in the connector-supporting hole 53, the elastic members 34*a* fitted in the through holes 31*ah* of the connector case 31*a* are disposed near the upper face 512 of the housing 51. That is, the lower side portion of the elastic member 34*a* is compressed by the housing 51 against the connector case 31*a*. The upper side portion of the elastic member 34*a* is exposed from the connector-supporting hole 53.

As the lower side portion of the elastic member 34*a* is compressed by the housing 51, the connector case 31*a* is pressed toward the center of the connector case 31*a* in the radial direction by the lower side portion of the elastic member 34*a* at an equal angular interval (at the interval of 90 degrees in the present embodiment). As a result, the elastic member 34*a* regulates the movement of the connector case 31*a* in the radial direction (the horizontal direction in FIG. 9).

As described above, the connector case 31*a* is fixed by the elastic members 34*a* at the upper end of the connector-supporting hole 53, similar to the connector case 31 (see FIG. 6) of the first embodiment. The connector case 31*a* is not movable in the radial direction of the connector case 31*a*. The connector case 31*a* is fixed by the latch claw 541 and the latch groove 312 at the lower end of the connector-supporting hole 53. The connector case 31*a* is not movable in the longitudinal direction (the vertical direction) of the connector case 31. Even when a desk with the microphone stand 4 is placed thereon is shaken, the microphone 2 thus does not pendulum on the latch claw 541 as a pivot, for example. As a result, the electrical connections between the connector case 31*a* and the latch claw 541 and between the connector case 31*a* and the ground terminal 524 become stable. That is, the ground line for the microphone 2 becomes stable.

SUMMARY

In the microphone 2 according to the embodiment described above, the connector case 31*a* includes the through holes 31*ah* in which elastic members 34*a* are disposed instead of the groove 311 of the connector case 31 in the first embodiment. The microphone 2 in the present embodiment restrains the backlash relative to the microphone stand 4 and facilitates mounting to and dismounting from the microphone stand 4 of the microphone 2, similar to the microphone 1 in the first embodiment. That is, the microphone according to the present invention restrains backlash relative to a microphone stand and facilitates mounting to and dismounting from a microphone stand of a microphone.

In the embodiments described above, the microphones 1 and 2 do not include the microphone stand 4. Alternatively, a microphone according to the present invention may include a microphone stand. Thus, an exemplary microphone according to the present invention includes a microphone unit, an output connector configured to output sound signals from the microphone unit, a case accommodating the output connector, and a microphone stand having a connector-supporting hole.

The invention claimed is:

1. A microphone to be mounted to and dismounted from a microphone stand that comprises a base housing having a connector mounting hole and an input connector having a connector-supporting hole and being mounted into the connector mounting hole, the microphone comprising:

a microphone unit;

an output connector to be coupled with the input connector and configured to output sound signals from the microphone unit;

a case accommodating the output connector; and an elastic member disposed on an outer circumferential surface of the case, wherein at least a portion of the elastic member is configured to fit into the connector-supporting hole while a portion of the case is inserted in the connector-supporting hole.

2. The microphone according to claim 1, further comprising:

a circuit board including a circuit disposed thereon and configured to output sound signals from the microphone unit to the output connector, wherein the circuit board is accommodated in the case.

3. The microphone according to claim 1, wherein the elastic member is configured to have a portion exposed from the connector-supporting hole while a portion of the case is inserted in the connector-supporting hole.

4. An assembly, comprising:

a microphone unit;

an output connector configured to output sound signals from the microphone unit;

a case accommodating the output connector;

a microphone stand; and an elastic member disposed on an outer circumferential surface of the case, wherein the microphone stand comprises:

a base housing having a connector mounting hole; and an input connector having a connector-supporting hole and being mounted into the connector mounting hole, wherein the case is configured for mounting to and dismounting from the connector-supporting hole, and the output connector is coupled with the input connector and at least a portion of the elastic member is configured to fit into the connector-supporting hole while a portion of the case is inserted in the connector-supporting hole.

5. The assembly of claim 4, wherein a portion of the elastic member is exposed from the connector-supporting hole while a portion of the case is inserted in the connector-supporting hole.

6. The assembly of claim 5, wherein the input connector comprises a pin-receiving portion to be coupled with the output connector, and an input connector housing accommodating the pin-receiving portion, the connector-supporting hole is disposed between the pin-receiving portion and the input connector housing, and the diameter of an imaginary circle circumscribing the elastic member is larger than the inner diameter of the input connector housing.

7. The assembly according to claim 4, wherein the case has a groove, the groove is disposed on the outer circumferential surface of the case, and the elastic member is disposed in the groove.

8. The assembly according to claim 7, wherein the elastic member fitted in the groove is disposed near an upper face of the input connector housing while a portion of the case is inserted in the connector-supporting hole.

9. The assembly according to claim 7, wherein the elastic member comprises an upper side portion and a lower side portion, the upper side portion is exposed from the connector-supporting hole while the portion of the case is inserted in the connector-supporting hole, and the lower side portion is compressed by the input connector housing against the connector case in an entire circumference and is deposed in the connector-supporting hole.

10. The assembly according to claim 7, wherein the elastic member is an O-ring.

11. The assembly according to claim 5, wherein the case comprises at least one through hole, and the elastic member is disposed in the through hole.

* * * * *